US006760954B1

(12) United States Patent
Rucker

(10) Patent No.: US 6,760,954 B1
(45) Date of Patent: Jul. 13, 2004

(54) DOOR BUMPER

(76) Inventor: George Rucker, 3717 Bethel Bay St., N. Las Vegas, NV (US) 89032

( * ) Notice: Subject to any disclaimer, the term of this patent is extended or adjusted under 35 U.S.C. 154(b) by 0 days.

(21) Appl. No.: 09/757,189

(22) Filed: Jan. 9, 2001

(51) Int. Cl.[7] ..... E05F 5/06

(52) U.S. Cl. ..... 16/85; 16/86 A; 16/49; 16/32; 16/374; 16/86 C; 292/341.15

(58) Field of Search ..... 16/85, 86 A, 86 R, 16/86 C, 49, 82, 374, DIG. 20; 292/DIG. 15, 341.15, 198, 228, 69

(56) References Cited

U.S. PATENT DOCUMENTS

| | | | | | |
|---|---|---|---|---|---|
| 768,825 | A | * | 8/1904 | Smith | 16/82 |
| 2,031,897 | A | * | 2/1936 | Luce | 292/228 |
| 2,109,127 | A | * | 2/1938 | Carlson | 292/69 |
| 2,596,780 | A | | 5/1952 | Meyers | 16/86 A |
| 2,700,788 | A | | 2/1955 | Hennelly | 16/86 |
| 2,767,421 | A | | 10/1956 | Fremstad | 16/86 |
| 3,863,967 | A | * | 2/1975 | Carrier | 292/198 |
| 4,782,553 | A | | 11/1988 | Morrison | 16/86 A |
| 4,982,474 | A | * | 1/1991 | Kjellstrom | 16/82 |

* cited by examiner

*Primary Examiner*—Anthony Knight
*Assistant Examiner*—Lisa Bannapradist

(57) ABSTRACT

An improved laterally resilient and displaceable mechanical door bumper for moving an elongated retractable shaft. The body or mold of the door bumper includes a base portion in which mounting screws are firmly anchored into the wood of the adjacent door portion. The door bumper shaft includes a rubber end piece that is glued and snapped onto the end of the door bumper shaft for cushioning the impact of the door bumper against a wall. The side of the door bumper receives rollers which are attached to the side portion of the mold and can be compressed during impact. The rollers are adapted to contact a door frame, which forces the door bumper shaft to retract. The door bumper is devoid of separable parts or sharp edges that might injure persons, particularly children, who come in contact with the door bumper.

4 Claims, 4 Drawing Sheets

FIG. 1.
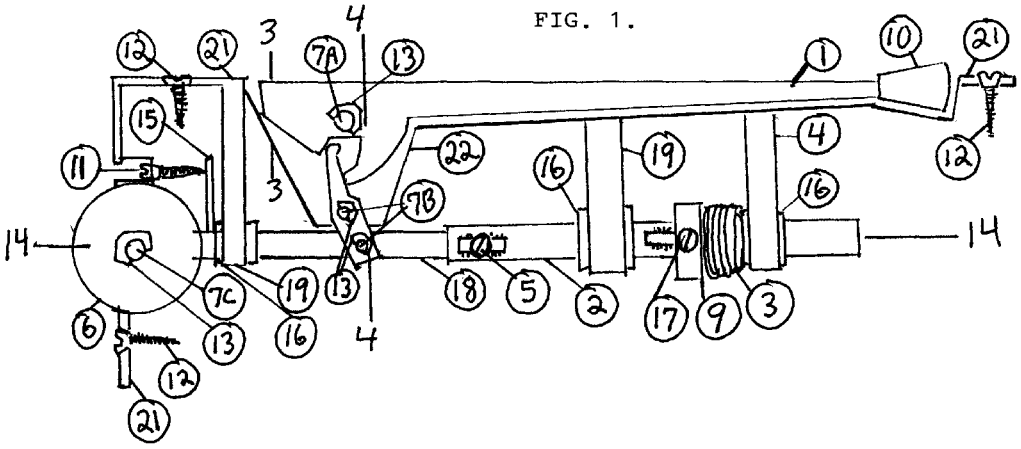
FIG. 2.
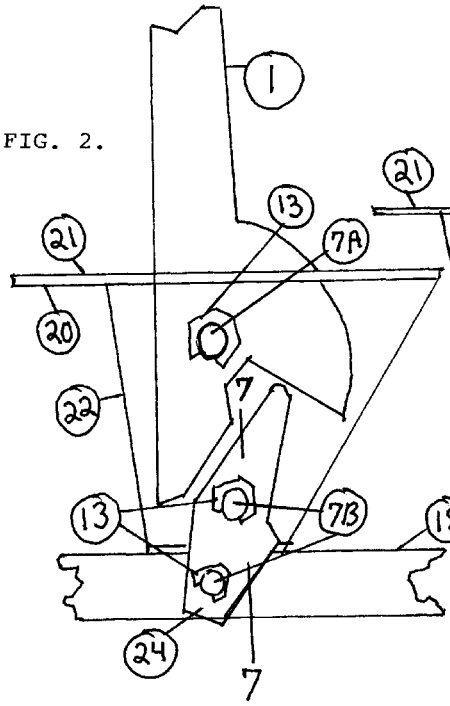
FIG. 3.
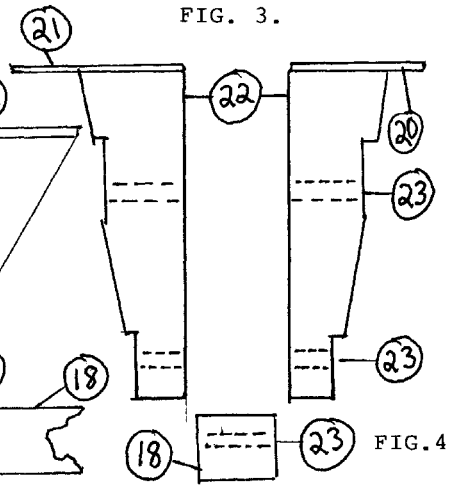
FIG.4.

FIG. 5.
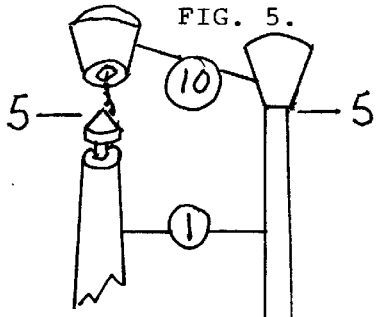
FIG. 6.
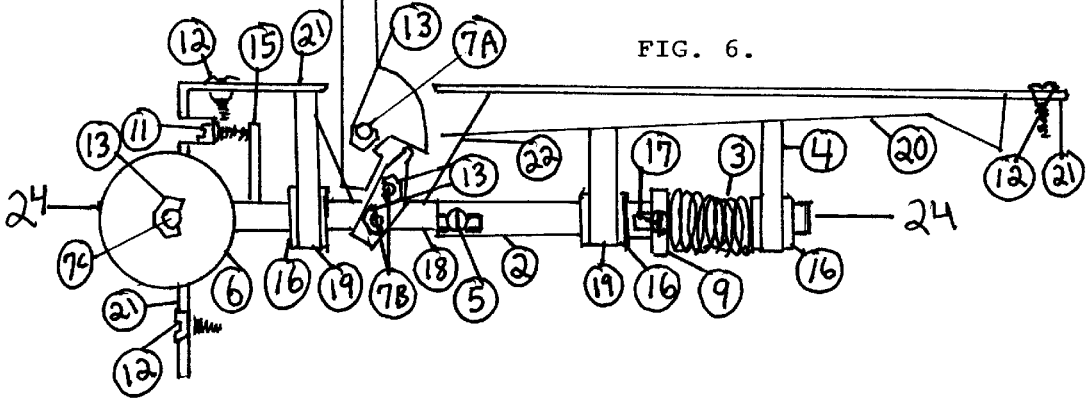
FIG. 7.
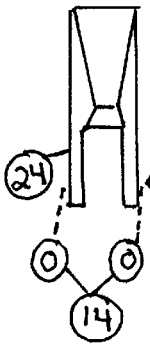
FIG. 8.
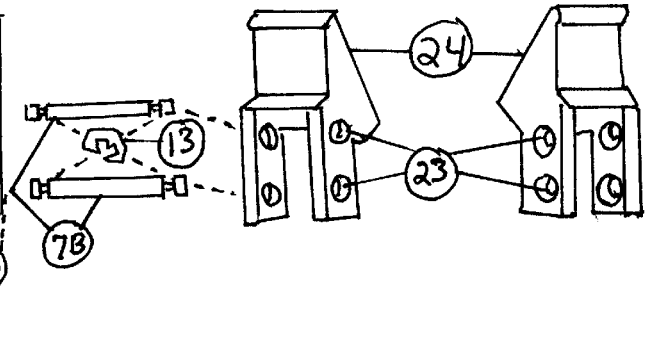
FIG. 9.

FIG. 16.
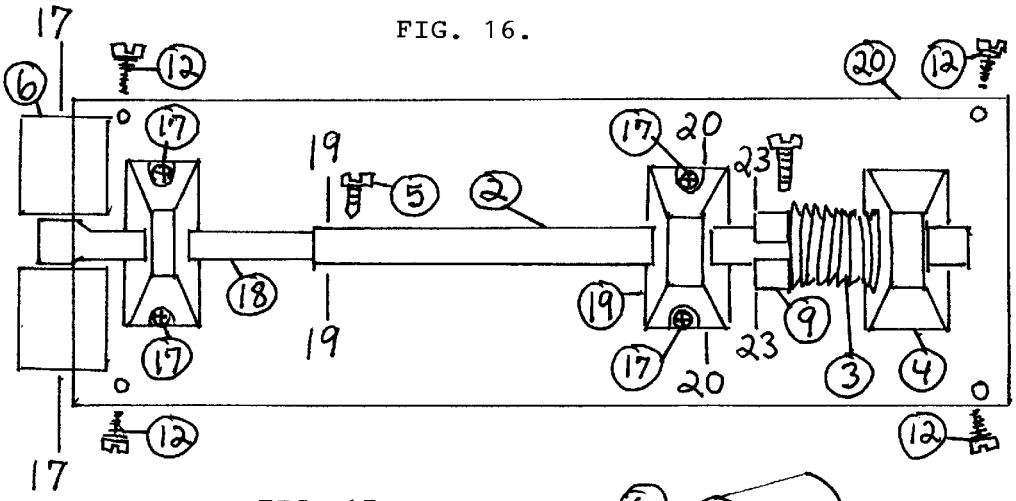
FIG. 17.
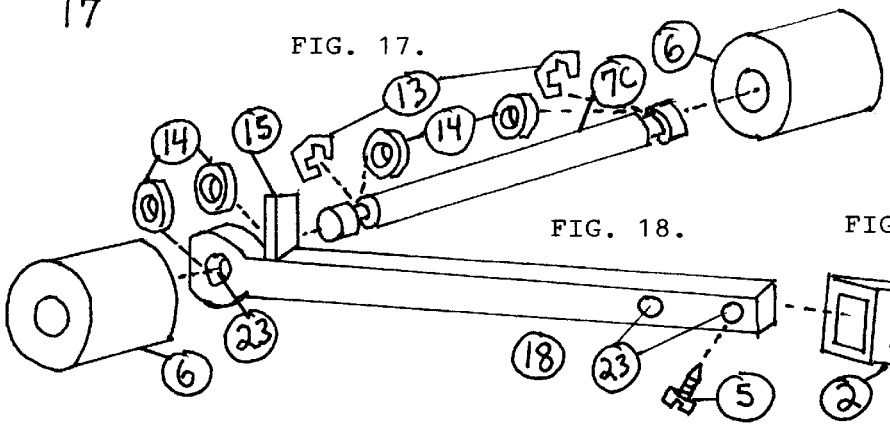
FIG. 18.
FIG. 19.
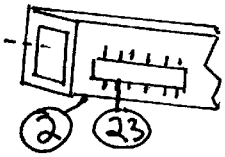
FIG. 20.
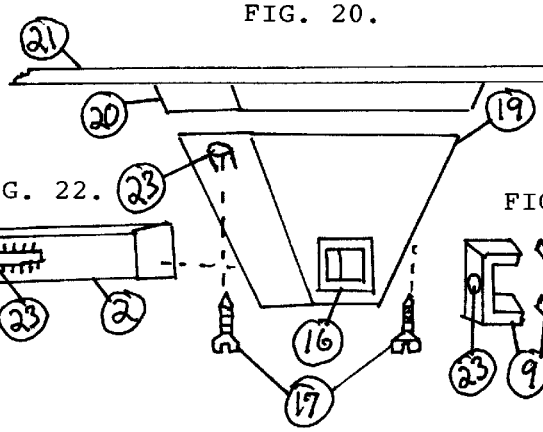
FIG. 21.
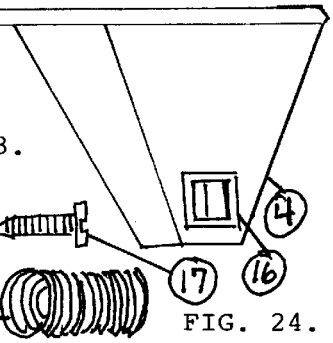
FIG. 22.
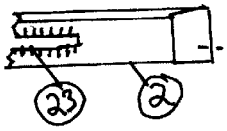
FIG. 23.
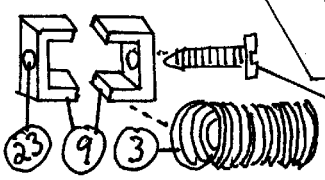
FIG. 24.

DOOR BUMPER

BACKGROUND OF THE INVENTION

1. Field of the Invention

The present invention relates generally to door hardware and more particularly to an improved door stop.

2. Description of the Related Art

Simply stated, a door stop is a device to be mounted behind a door to arrest opening movement of the door before the door or its handle strikes an adjacent wall or other member behind the door. Some door stops are secured to the wall or attached onto the door. This invention is concerned with door stops of the latter kind. For convenience, this latter kind of door stop is referred to as a wall mounted stop, although the stop may be secured to a support other than a wall. Wall mounted door stops are available in at least two different types. One type is a rigid stop constructed of metal with a cushion tip at one end and a screw at the other end to be threaded in the wall or other support. The other type comprises a flexible coil spring-like extension having a cushion tip at one end and a screw at the other end. Both of these existing stops are installed by threading the screws into a baseboard or other support behind the door. The stop is not laterally yieldable and may cause the screw to break if contacted by an object that produces a lateral impact on the stop. Also, the stop may cause injury to a child or other person who accidentally comes in contact with the stop, particularly if its cushion tip has separated from the stop. The spring-like coil stop avoids such impact to the door, but suffers from the disadvantage that it often bends or buckles under the impact of the door, thus allowing the door to strike the wall or other protected object. Both of these existing kinds of stops suffer from the disadvantage that they tend to collect dirt. The cushion tips of the stops tend to separate from the stops and the non-cushioned stop will damage a door or baseboard. Accordingly, a definite need exists for an improved door stop that is free of the noted problems.

SUMMARY OF THE INVENTION

The improved door bumper of this invention has a support mold including an elongated retractable shaft and a large rubber end piece for contact with the wall to stop the door. The base portion of the elongated shaft is molded or otherwise formed from metal material. When the door strikes the wall, the door bumper's rubber end piece yields slightly to stop the door with a cushioned action which avoids damage to the wall. Another feature of the invention resides in the fact that the shaft of the door bumper is retracted when the door is closed, locking in place the rubber end piece and thus avoiding the possibility of injury to a child in the room. If the shaft is extended outward the stop yields and returns to its initial position when the force is removed. The rubber end piece snaps on and is glued. The door bumper is also pleasing in appearance and may be made in various polished metals that will match the texture of the door handle. The door stop can be placed on any corner of the door.

BRIEF DESCRIPTION OF THE DRAWINGS

FIG. 1 is a larger side view showing the stop in a closed position;

FIG. 2 is a larger side view of the stop taken at line 2—2 of FIG. 6;

FIG. 3 is a rear view of the gear support mold taken at line 3—3 of FIG. 1;

FIG. 4 is a rear partial cross-sectional view taken at line 4—4 of FIG. 1;

FIG. 5 is a partial cross-sectional view of the rubber end piece and its support on the shaft taken at line 5—5 of FIG. 6;

FIG. 6 is a larger side view similar to FIG. 1 showing the stop in an open position;

FIG. 7 is a front partial cross-sectional view taken at line 7—7 of FIG. 2;

FIG. 8 is a right side view of FIG. 7;

FIG. 9 is a left side view of FIG. 7;

FIG. 16 is a view of the bottom supporting plate of the door stop showing the fastening of the present invention;

FIG. 17 is a partial view of the gear assembly taken at line 17—17 of FIG. 16;

FIG. 18 is a side view of the supporting gear shaft;

FIG. 19 is a partial cross-sectional view of the connecting shaft taken at line 19—19 of FIG. 16;

FIG. 20 is a cross-sectional view of the supporting assembly taken at line 20—20 of FIG. 16;

FIG. 21 is a view similar to FIG. 20 showing a support bracket;

FIG. 22 is a partial view of a gear shaft taken from FIG. 19;

FIG. 23 is a larger cross-sectional view taken at line 23—23 of FIG. 16;

FIG. 24 is a larger cross-sectional view taken at line 24—24 of FIG. 6.

DETAILED DESCRIPTION OF THE DRAWINGS

Figure 10:
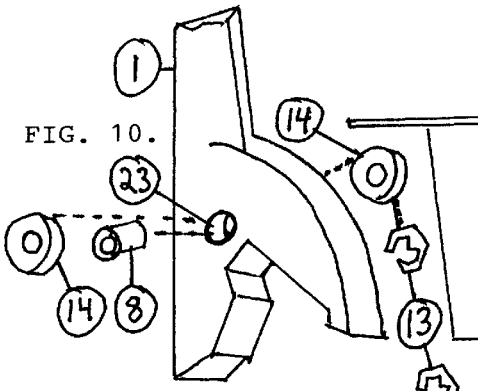
FIG. 10 is a side front view of FIG. 2.
Figure 11:
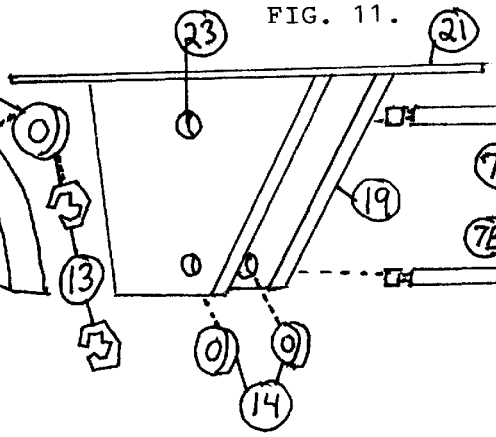
FIG. 11 is a side front view of the supporting bracket.
Figure 12:
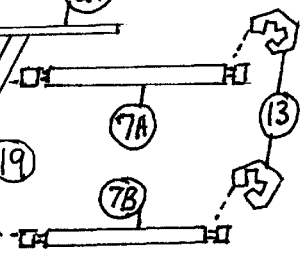
FIG. 12 is a front view of the gear shaft assembly and its support.
Figure 13:
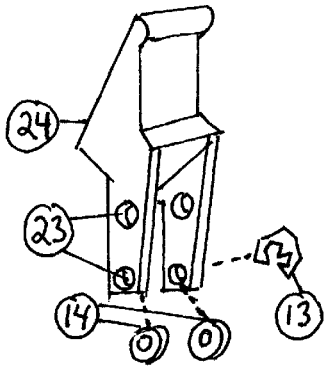
FIG. 13 is a side view of the gear assembly.
Figure 14:
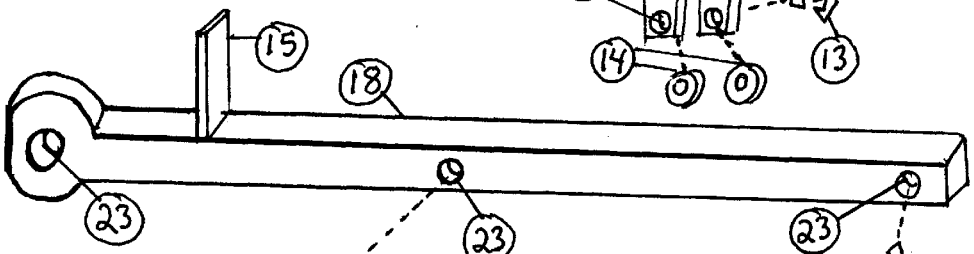
FIG. 14 is an enlarged side front view taken at line 14—14 of FIG. 1.
Figure 15:
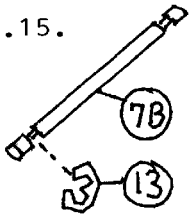
FIG. 15 is a front view of the supporting bolt.

Turning now to the drawings. The door bumper assembly is designed to fit inside a corner of a door. The improved door bumper shaft designated by general reference number (1) is substantially straight and has an elongated rectangular shape. A rubber end piece (10) is located at one end of the door bumper shaft. The shaft is made of metal and is adapted to yield without lateral deflection to cushion longitudinal impact of a vertical surface such as a wall against the rubber end piece and shaft. The door bumper shaft is supported by the gear support mold (22) at the other end and mounted to the gear support mold by a door bumper shaft pinion bolt **(7*a*) attachment. The door bumper is further locked into place within the gear support mold by lock washers (13). The door bumper shaft is uniformly tapered to a diminishing diameter from the gear support mold (22) to the rubber end piece (10)**.

The gear support mold is made from a front face plate (21) and a plurality of elongated support members of substantially equal length (see FIG. 3). The front face plate is formed with a longitudinal groove following the shape of the door bumper shaft and the support members are spaced in a substantially parallel manner to house the door bumper shaft flush with the front face plate in a retracted or locked position (FIG. 1).

Contacting the door bumper shaft (1) from underneath is a swivel gear (24), which is also connected to the gear support mold (22) by a swivel gear pinion bolt (7*b*) and a similar lock washer (14). The swivel gear is further attached to a roller gear shaft (18) by a roller pinion bolt (7*c*).

The roller gear shaft rides on a syncline-shaped main bearing bracket (19), which is connected to the gear support mold (22) and secures a smooth support of the roller gear shaft by a square hard plastic bearing (16). Connected to one end of the roller gear shaft (18) is a set of rollers (6) attached to the roller gear shaft by a roller pinion bolt (7*c*). These rollers can be made from a hard plastic material. The other end of the roller gear shaft is connected onto a roller gear tube (2). The roller gear tube also rides on syncline-shaped main bearing brackets (19 and 4) by square-shaped hard plastic bearings (16). The roller gear shaft and the roller gear tube are both made of metal and are of substantially equal length.

The rollers (6) are arranged in the assembly to strike the inside edge of the doorframe. When the door is closed and the rollers come in contact with the doorframe forcing the rollers inward, this causes the roller gear shaft (18) to move in the longitudinal direction further inside the door. This translation of the roller gear shaft (18) then causes the swivel gear to rotate within the gear support mold (22). The swivel gear in turn forces the door bumper shaft towards a locked or retracted position (see FIG. 1).

The opposite case is also described when the door is opened and the rollers lose contact with the doorframe. A heavy-duty spring (3) is located on the roller gear tube (2) between a square-shaped adjustment clamp (9) and the square-shaped hard plastic bearing (16) and biases the rollers in an outwardly maintained position. The roller gear shaft (18) is also forced outward, further causing rotation of the swivel gear. The tip of the swivel gear rotates towards a foot located on the inside of the door bumper shaft thus forcing the door bumper shaft to rotate and extend into a protracted or unlocked position perpendicular to the door (see FIGS. 2 and 3).

The door bumper assembly contains additional features to adjust the arrangement of the assembly within the door. First, the adjustment clamp (9) is secured to the roller gear tube (2) by bolt (17). This adjustment clamp can be moved to control the tension in the spring (3) accordingly. Second, the roller gear shaft and the roller gear tube (2) are disposed in telescopic relation whereby an adjustment screw (5) can be repositioned to lengthen or shorten the distance between the two parts. Lastly, the roller gear shaft (18) also contains a metal stop plate (15) that rests against an adjustment strike plate screw (11) to position the rollers (6) in precise placement with the doorframe. The adjustment strike plate screw (11) is fastened to and extends from the outside of gear support mold (22).

A door stop in accordance with this invention consists in the novel construction and combination of parts of a door stop fully described above and as illustrated in several forms of embodiment in the accompanying drawings. It is understood that various changes in the form, portions, and manner of assemblage of the elements of this invention can be made as fully described with reference to the above specification, claims and drawings.

REFERENCE NUMERALS IN DRAWINGS

1. Door bumper shaft
2. Roller gear tube
3. Tension spring
4. Support bearing mold
5. Adjustment screw for bumper
6. Roller
7*a*. Door bumper shaft pinion bolt
7*b*. Swivel gear pinion bolt
7*c*. Roller pinion bolt
8. Bearing
9. Spring tension adjustment clamp
10. Rubber end piece
11. Adjustment strike plate screw
12. Screw
13. Lock washer
14. Plastic spacer washer
15. Stop plate
16. Hard plastic bearing
17. Bolt
18. Roller gear shaft
19. Main bearing bracket
20. Bottom of support mold
21. Front face plate
22. Gear support mold
23. Bolt hole
24. Swivel gear

I claim:

1. A door bumper comprising:

an elongated rigid door bumper shaft capable of rotational movement from a retracted position to a protracted position, a roller gear shaft positioned adjacent to the door bumper shaft, a swivel gear attached to the gear shaft and connected to the door bumper shaft, a roller attached to one end of the gear shaft, the arrangement of the door bumper shaft, the gear shaft, the swivel gear and the roller is such that when the arrangement is positioned within a door, the roller is adapted to contact a door frame and cause reciprocal movement of the gear shaft which causes rotational movement of the swivel gear to thus effect retraction of the door bumper shaft and when the roller is not in contact with the door frame the arrangement causes protraction of the door bumper shaft.

2. The door bumper of claim 1 further comprising a spring biasing the roller so that the door bumper shaft is in the protracted position.

3. The door bumper of claim 1 further comprising a rubber end piece at one end of the door bumper shaft adapted to yield without lateral deflection to cushion longitudinal impact of the door bumper shaft against a vertical surface.

4. The door bumper of claim 1 further comprising an adjustment mechanism adapted to adjust the position of the roller such that the position of the roller can be changed when the door bumper is installed.

* * * * *